United States Patent [19]

D'Andrea, Jr.

[11] Patent Number: 4,529,064

[45] Date of Patent: Jul. 16, 1985

[54] GRAVITY CRANE

[76] Inventor: Rocco A. D'Andrea, Jr., 91 Wyman Ave., Huntington Station, N.Y. 11746

[21] Appl. No.: 638,350

[22] Filed: Aug. 6, 1984

[51] Int. Cl.[3] ..... B66B 11/04; B66C 23/72; B66C 23/06; B66C 23/82

[52] U.S. Cl. ..... 187/21; 212/195; 212/196; 212/255; 212/263

[58] Field of Search ..... 182/3, 141–142; 187/1 R, 94, 21; 212/195–196, 255, 263

[56] References Cited

U.S. PATENT DOCUMENTS

| | | | |
|---|---|---|---|
| 7,236 | 7/1876 | Bates | 187/21 |
| 445,824 | 3/1891 | Smith | 187/21 |
| 2,195,299 | 3/1940 | Frankel | 182/3 |
| 3,098,539 | 7/1963 | Gorman | 182/3 |
| 3,472,342 | 10/1969 | Wuesthoff | 187/94 X |
| 4,360,307 | 11/1982 | Larsson | 212/73 |
| 4,449,884 | 5/1984 | Motoda | 212/75 |

FOREIGN PATENT DOCUMENTS

| | | | |
|---|---|---|---|
| 36596 | 1/1923 | Norway | 182/3 |

*Primary Examiner*—Trygve M. Blix
*Assistant Examiner*—R. B. Johnson
*Attorney, Agent, or Firm*—Richard L. Miller

[57] ABSTRACT

A gravity crane which is manually operated by an operator who is harnessed to one end of a cantilevered balance beam. Clockwise moments are furnished by a fixed counterweight and by a adjustable ballast for coarse balancing. Counterclockwise moment is provided by the weight of the operator. By displacing a control weight located close to the operator the net sum of clockwise and counterclockwise moments may be smoothly shifted so that the operator can raise or lower himself with a minimum of effort, thereby simulating weightlessness. The operating control cord is always within reach of the operator and the entire crane may be swiveled on a rotatable base.

4 Claims, 2 Drawing Figures

GRAVITY CRANE

BACKGROUND OF THE INVENTION

The present invention relates generally, to lifting devices and, more specifically to cantilevered devices in which the sum of the moments may be varied by an operator suspended from one end of a cantilevered arm.

There are a number of situations in which it is desirable to be able to ascend and descend without any source of power other than muscle power. Manual ascent and descent may be used to simulate "anti-gravity" in the training of astronauts and divers. It may also be used in service and maintenance work, for example, in the replacement of elevated lighting fixtures. A machine with these capabilities could also be used as an exciting amusement ride in a carnival.

A number of cantilevered arm type machines have been suggested. B. Buzzichelli et al. (U.S. Pat. No. 4,155,463), W. McLean et al. (U.S. Pat. No. 3,653,486) and A. Briggs (U.S. Pat. No. 4,004,696) all provide cantilevered material handling devices but none of them provide for manual operation of the cantilevers by an operator suspended from one end of the cantilever.

SUMMARY OF THE INVENTION

It is, therefore, a primary object of the present invention to provide a gravity crane which can be raised or lowered manually by an operator suspended from one end of a balance beam. This is accomplished by coarsely balancing the beam and manually shifting the point of action of one of the cantilevered weights, thereby shifting the sum of the moments gradually from a clockwise sum to a counterclockwise sum.

A further object of the present invention is to provide a gravity crane in which the pedestal which holds the cantilevered beam may be swiveled.

A further object of the present invention is to provide a gravity crane which raises or lowers the operator when the operator pulls on one of two control cords that are always within reach.

A yet further object of the present invention is to provide a gravity crane which requires very little control power to be exerted by the control operator, in order to raise or lower the cantilevered beam.

Further objects of the present invention will appear as the description proceeds.

To the accomplishment of the above and related objects, this invention may be embodied in the form illustrated in the accompanying drawings, attention being called to the fact, however, that the drawings are illustrative only and that changes may be made in the specific construction illustrated and described within the scope of the appended claims.

BRIEF DESCRIPTION OF THE DRAWING FIGURES

The figures in the drawings are briefly described as follows.

DETAILED DESCRIPTION OF THE PREFERRED EMBODIMENTS

Figure 1:
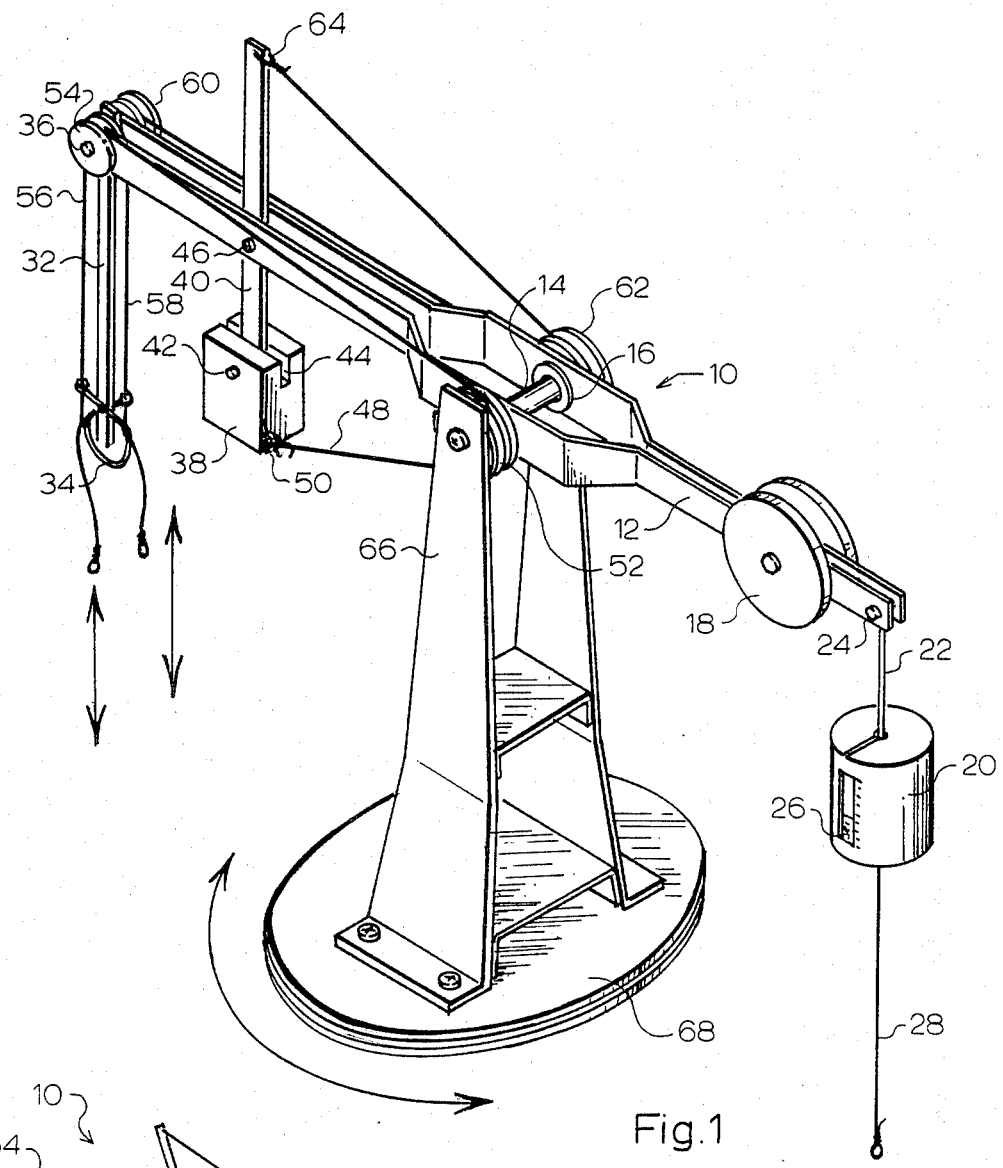
FIG. 1 is an isometric view of the invention.
Figure 2:
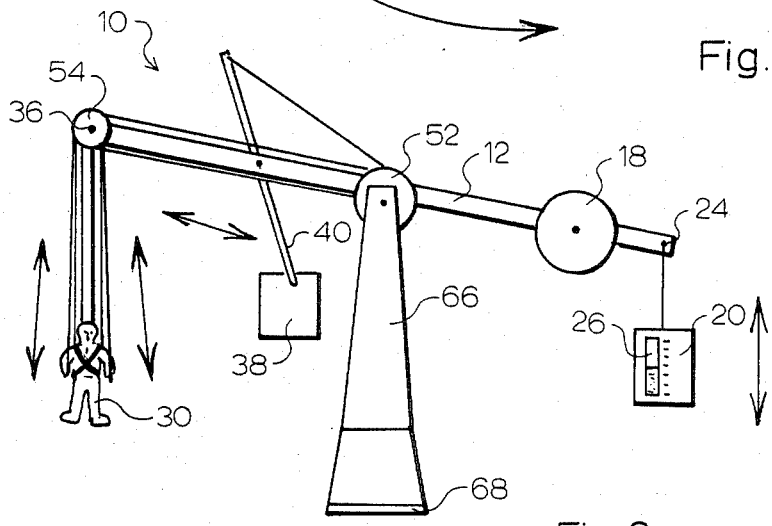
FIG. 2 is a diagrammatic side view of the invention.

In the invention 10, balance beam 12 acts as a cantilever with its fulcrum at fulcrum axle 14. Ease of rotation of balance beam 12 about fulcrum axle 14 is facilitated by two bushings, one of which is illustrated as 16. Fixed clockwise moments are provided by fixed counterweight 18 and a water ballast chamber 20 attached to balance beam 12 by rod 22 at pivot 24. The water level in water ballast chamber 20 may be adjusted to a level which may be viewed at water weight scale 26 in order to obtain a coarse balance. A pull cord 28 may be provided to lower the end of balance beam 12 to which water ballast chamber 20 is attached. Fixed counterclockwise moment is provided by the weight of operator 30, secured to connecting rod 32 by harness 34. Connecting rod 32 is pivotally connected to balance beam 12 by harness axle 36 so that operator 30 is always perpendicular to the ground.

The contribution of clockwise or counterclockwise moment by control weight 38 is determined by its displacement from equilibrium position. Control weight 38 is suspended pivotally from moment adjustor arm 40 by pivot 42. A notch 44 in control weight 38 allows for this pivoting. Moment adjustor arm 40 is, in turn, suspended pivotally from balance beam 12 by pivot 46. Displacement of control weight 38 from its equilibrium position is accomplished by a configuration of cords and pulleys. Control line 48 is attached to control weight 38 at 50, loops around first fulcrum guide pulley 52, loops around first harness guide pulley 54, passes downwards along connecting rod 32 at 56, loops 180° continuing upwards along connecting rod 32 at 58, loops around second harness guide pulley 60, loops around second fulcrum guide pulley 62, and, terminates by connection to the top of moment adjustor arm 40 at 64. If an operator 30 pulls on the control cord at 56, control weight 38 will be displaced to the right, balance beam 12 will rotate clockwise and operator 30 will be further elevated. Conversely, if operator 30 pulls on the control cord at 58, control weight 38 will be displaced to the left, balance beam 12 will rotate counterclockwise and operator 30 will begin to descend. The continuous nature of the control cable assures the operator that he will not lose access to the control cord.

A pedestal 66, which may be of any configuration supports balance beam 12. A rotating base 68 permits the invention 10 to be swiveled.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. Gravity crane comprising in combination:

(a) a cantilevered balance beam with a respective first and second end, a fulcrum pivotally attached to said beam intermediate said ends;

(b) a fixed counterweight attached near said first end of said cantilevered balance beam;

(c) an adjustable balance weight located near said first end and in close proximity to said fixed counterweight;

(d) a connecting rod, an axle pivotally mounting said connecting rod to said second end of said beam, an operator's harness connected to said connecting rod such that an operator may be attached thereto so as to always be suspended vertically regardless of the rotation position of said beam about said fulcrum.

(e) a moment adjustor arm pivotally connected between ends thereof to said cantilevered balance beam at a point located between the point of attachment of said connecting rod and said fulcrum, a control weight pivotally suspended from said moment adjustor arm; said moment adjustor arm extending above and below said beam whereby, when said moment adjustor arm is displaced from its equilibrium position the sum of clockwise and counterclockwise moments around said fulcrum will change from a positive to a negative sum causing said cantilevered balance beam to rotate in a clockwise position if said control weight moves towards said fulcrum and counterclockwise if said control weight moves away from said fulcrum;

(f) a support means for supporting said cantilevered balance beam pivotally at said fulcrum; and, (g) a connecting means operatively connected to said connecting rod, moment adjustor arm and control weight for allowing said operator, when suspended from said harness, to rotate said moment adjustor arm about its pivot thereby causing said cantilevered balance beam to rotate about its fulcrum and, thereby raising and lowering said operator.

2. Gravity crane, as recited in claim 1, wherein said adjustable balance weight comprises a ballast chamber whereby ballast may be added or subtracted in order to adjust the coarse balance of said cantilevered balance beam.

3. Gravity crane, as recited in claim 1, wherein said support means comprises a fulcrum axle which passes through said fulcrum of said cantilevered balance beam and into a pedestal with rotatable base.

4. Gravity crane, as recited in claim 3, wherein said connecting means comprises a control cord which:

(a) is attached to the bottom of said control weight;

(b) passes through a first fulcrum guide pulley mounted to said fulcrum axle;

(c) passes through a first harness guide pulley mounted to said harness axle;

(d) extends downwards along said connecting rod within the reach of said operator held by said harness, loops 180° continuing upwards still within the reach of said operator;

(e) passes through a second harness guide pulley mounted to said harness axle;

(f) passes through a second fulcrum guide pulley mounted to said fulcrum axle; and, (g) is attached to the top of said moment adjustor arm; whereby said operator may pull on a selected portion of said control cord within said reach causing said operator to move up and down.

* * * * *